US005244272A

United States Patent [19]

Thompson

[11] Patent Number: 5,244,272

[45] Date of Patent: Sep. 14, 1993

[54] SPACE-SAVING UNDERCABINET SPICE JAR DRAWER

[76] Inventor: Donn K. Thompson, 1112 Brewster Ave., Redwood City, Calif. 94062

[21] Appl. No.: 970,079

[22] Filed: Nov. 2, 1992

[51] Int. Cl.[5] ..... A47B 88/00

[52] U.S. Cl. ..... 312/334.23; 312/323; 312/330.1; 312/348.3; 211/74; 211/80

[58] Field of Search ..... 312/322, 323, 330.1, 312/334.23, 348.3; 211/1, 3, 74, 79, 80, 126, 162; 108/26, 35, 69, 76, 143

[56] References Cited

U.S. PATENT DOCUMENTS

| | | | |
|---|---|---|---|
| 242,607 | 6/1881 | Cutler | 312/330.1 X |
| 2,839,349 | 6/1958 | Culver . | |
| 3,722,975 | 3/1973 | Taylor | 312/330.1 X |
| 3,975,071 | 8/1976 | Quinn . | |
| 4,184,725 | 1/1980 | Spangler . | |
| 4,314,734 | 2/1982 | Grunert | 312/322 |
| 4,441,771 | 4/1984 | Roesler . | |

FOREIGN PATENT DOCUMENTS

| | | | |
|---|---|---|---|
| 99322 | 10/1964 | Denmark | 312/348.3 |

*Primary Examiner*—Kenneth J. Dorner

*Assistant Examiner*—Brian K. Green

[57] ABSTRACT

A spacing-saving undercabinet spice jar drawer comprises a tray (10) with five transverse, semi-cylindrical channels (11) for holding spice jars (12) in rows. The sides of the tray have raised front flanges (15A and 15B) and rear flanges (17A and 17B), the spaces between the front and rear flanges being notches (16A and 16B). The flanges of the tray slide into two guide rails (23A and 23B) of a mounting bracket (20). The front ends of the rails have sloped portions (24A and 24B) which terminate in deep cradles (25A and 25B). The tray can be opened by pulling it straight out until the notches are over the cradles. The front (F) of the tray is then lowered until the front edges of the rear flanges engage the bottom of the cradles, and the rear edges of the rear flanges engage the underside of the mounting bracket, such that the tray is angled downwardly about 45 degrees. As positioned, the tray allows convenient viewing and access to the spice jars. Because the transverse channels hold the jars in lateral rows, each jar is supported by a portion of a channel while the tray is tilted. Therefore, the jars can be individually removed and replaced without disturbing other jars.

3 Claims, 2 Drawing Sheets

SPACE-SAVING UNDERCABINET SPICE JAR DRAWER

FIELD OF INVENTION

This invention relates generally to kitchen accessories, specifically to an undercabinet drawer for holding spice jars.

BACKGROUND OF THE INVENTION

Most kitchens are crowded places where countertop space is scarce. Toasters, coffee makers, microwave ovens, knife blocks, jars, bottles, cans, etc., are usually strewn all over the countertops in all but the most tidy kitchens. This not only reduces working space, but also reduces efficiency by making things difficult to locate among the mess. Multiple small jars of spice can be especially difficult to find and sort out because of their small sizes and relatively great numbers.

The well known Lazy Susan was invented to alleviate the countertop mess. By having small items such as spice bottles placed on a rotatable round board, the items can be organized and packed tightly together. The Lazy Susan, which can be placed on a countertop or in a cabinet, can be rotated so that each item is successively presented at the front of the unit, until the desired item can be found and retrieved. Although convenient, this invention still occupies precious counter or cabinet space.

Some drawer type devices have been designed to occupy no counter space by being mounted under existing cabinets. U.S. Pat. No. 2,839,349 to Culver (1958) shows a knife drawer with a pair of side rails which dip downwardly at the front ends, and a drawer with two pairs of rollers which ride within the rails. A third pair of rollers are mounted near the front of the rails to support the drawer, which tilts downward slightly when opened. However, the drawer is locked inside the side rails and cannot be removed for cleaning. In addition, it is quite complicated in construction, and therefore relatively expensive to manufacture.

U.S. Pat. No. 4,184,725 to Spangler (1980) shows a book drawer with a central book-holding bar. Two side rails guide the drawer, which may be pulled open and tilted downwardly until a forwardly positioned rod under the book-holding bar stops the drawer. This drawer is also locked inside the side rails and cannot be removed for cleaning. Moreover, it has no provision for holding spice jars, and cannot be easily adapted to do so.

U.S. Pat. No. 4,441,771 to Roesler (1984) shows a drawer with two side rails and a pair of studs near the back. The drawer slides on two side supports with front recesses which receive the studs to allow the drawer to tilt downwardly. The drawer is divided by flat partitions into multiple compartments. Although easy to open and tilt downwardly, this drawer cannot be conveniently closed: The entire drawer must be evenly lifted to disengage the studs from the front recesses before the drawer can be slid closed.

In conclusion, existing trays and drawers either occupy valuable contertop space, cannot be removed from the mounting rails for cleaning, provide no provision for holding spice jars and cannot be adapted to do so, or cannot be operated easily and conveniently.

SUMMARY OF THE INVENTION

Accordingly, several objectives and advantages of the invention are to provide a spice jar drawer which conveniently and securely holds multiple jars, which allows the jars to be removed and replaced with ease, which may be easily opened and tilted downwardly at a substantial angle to allow easy viewing and removal of its contents, which may be easily closed, which may be easily removed from its mountings for cleaning, and which is simple and economical to manufacture.

Further objectives and advantages will become apparent from a study of the following description and the accompanying drawings.

In a preferred embodiment of the invention, the space-saving undercabinet spice jar drawer comprises a rectangular tray with multiple transverse, semi-cylindrical channels for holding jars in lateral rows. The tray has two raised, long side flanges, each having a notch near the rear. The flanges of the tray slide into two side rails of a mounting bracket. The front ends of the rails have sloped portions which terminate in deep cradles.

The tray can be easily opened by pulling it straight out until the notches are over the cradles. The front of the tray is then lowered until the rear edges of the notches engage the bottom of the cradles, and the rear ends of the flanges engage the top of the mounting bracket, such that the tray is angled downwardly about 45 degrees. As positioned, the tray will allow convenient viewing and access to the spice jars. Because the transverse channels hold the jars in lateral rows, each jar is supported by a portion of a channel. Therefore, the jars can be individually removed and replaced without disturbing other jars.

The tray can be easily closed by lifting its front edge until the tray is in a horizontal position, then pushing it inwardly until it is fully inside the mounting bracket. It can also be easily removed for cleaning by pulling it straight out of the mounting bracket while keeping it in a horizontal position.

DRAWING REFERENCE NUMERALS

| | |
|---|---|
| 10. Tray | 11. Channel |
| 12. Jar | 13. Handle |
| 14. Side Wall | 15. Front Flange |
| 16. Notch | 17. Rear Flange |
| 20. Mounting Bracket | 21. Plate |
| 22. Hole | 23. Guide Rail |
| 24. Sloped Portion | 25. Cradle |
| 26. Kitchen Cabinet | |
| F. Front End | |

DESCRIPTION —FIG. 1

Figure 1:
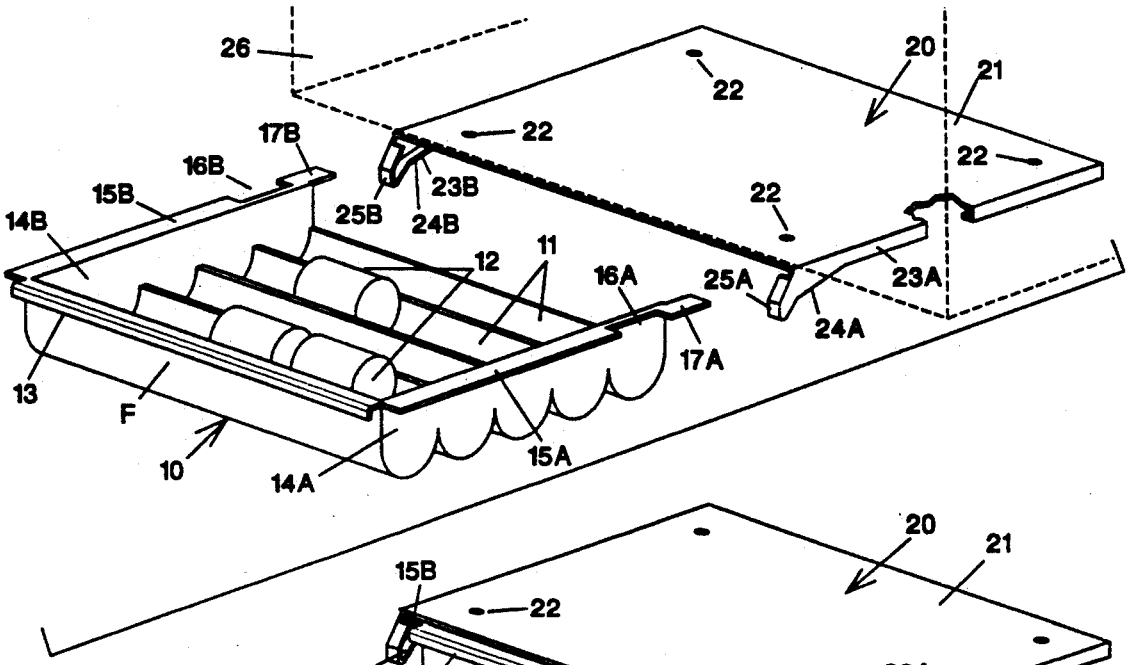
FIG. 1 is a perspective and partial sectional view of a space-saving undercabinet spice jar drawer in accordance with a preferred embodiment of the invention.

In accordance with a preferred embodiment of the invention shown in FIG. 1, a space-saving undercabinet spice jar drawer comprises a tray 10 having a front end F, and a mounting bracket 20. Tray 10 comprises five transversely arranged, semi-cylindrical channels 11 for neatly holding and organizing multiple spice jars 12. An inverted "L beam" shaped handle 13, which spans the width of tray 10, extends from the top front edge of the tray. Two vertical side walls 14A and 14B, each slightly taller than the radius of channels 11, extend upwardly from the ends of the channels to above jars 12. Two long, horizontal front flanges 15A and 15B extend outwardly from the top edges of the front portions of side walls 14A and 14B, respectively. Two short rear flanges 17A and 17B are attached to the rear portions of the side walls, and extend rearwardly beyond the rear edges of the innermost channel 11. The spaces between front flanges 15A and 15B and rear flanges 17A and 17B are notches 16A and 16B, respectively.

Mounting bracket 20 comprises a generally square plate 21 with four mounting holes 22 near the corners. Plate 21 has two guide rails 23A and 23B having "L beam" shaped cross sections, which have sloped portions 24A and 24B, respectively, near their front ends which angle downwardly about 20 degrees. Sloped portions 24A and 24B terminate in deep V-shaped cradles 25A and 25B, respectively. The front portions of the cradles extend upwardly to the same level as guide rails 23A and 23B. Mounting bracket 20 is shown mounted under a kitchen cabinet 26 using screws (not shown) through holes 22, such that the front edge of the bracket is flush with the front of the cabinet.

DESCRIPTION —FIG. 2

Here the spice jar drawer is shown with tray 10 fully closed under mounting bracket 20. Front flanges 15A and 15B (partially shown) and rear flanges 17A and 17B (FIG. 1) of tray 10 are slid into side rails 23A and 23B (FIG. 1), respectively, such that handle 13 of tray 10 is almost flush with the front edge of bracket 20.

OPERATION—FIGS. 3A TO 3C—OPENING

Figure 3A:
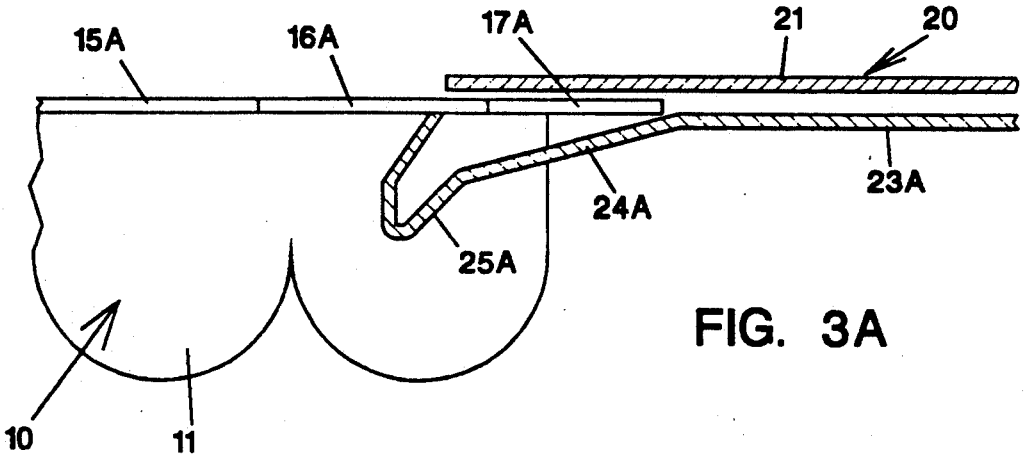
FIGS. 3A to 3C are partial side sectional views of the drawer of FIG. 1, showing its sequence of operation.
Figure 3B:
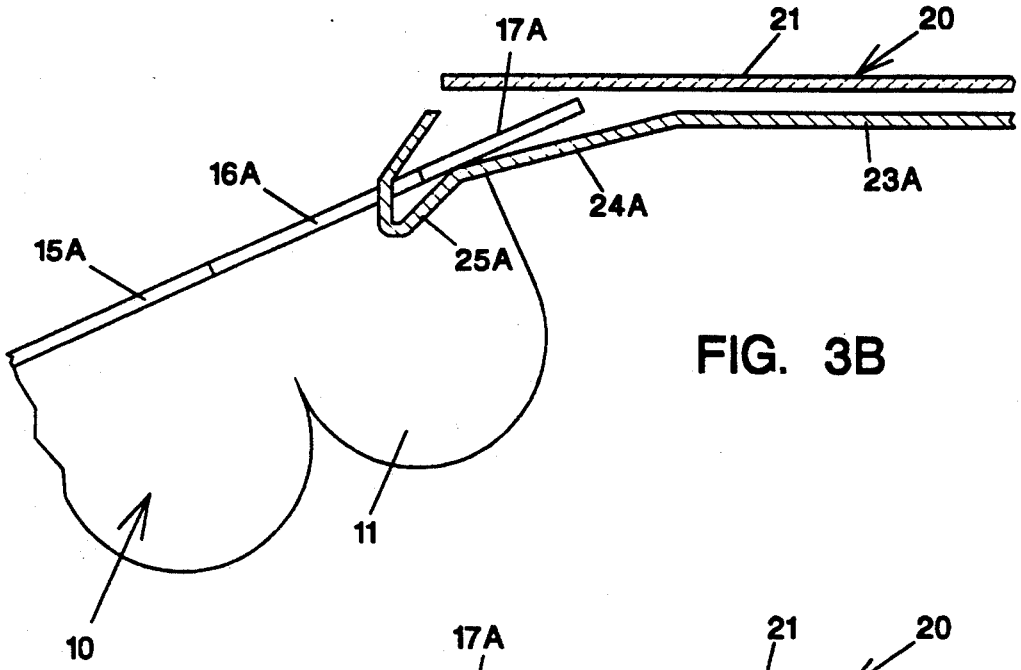
Figure 3C:
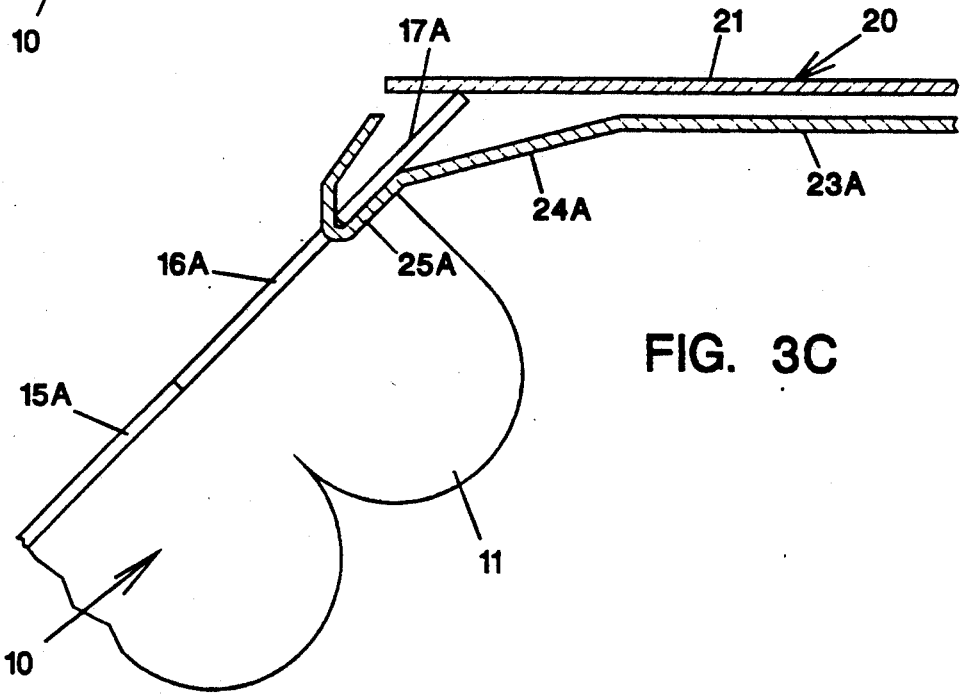

The right side (the side closest to the viewer) of the spice jar drawer shown in FIG. 1 is shown in partial sectional views in FIGS. 3A to 3C. As shown in FIG. 3A, the spice drawer may be easily opened by pulling tray 10 straight out by handle 13 (FIG. 1), until notch 16A is directly over cradle 25A. Front end F (FIG. 1) of drawer 10 is then tilted downwardly such that notch 16A passes through the front portion of cradle 25A, as shown in FIG. 3B. The tall front portion of cradle 25A will block the forward movement of rear flange 17A unless tray 10 is perfectly horizontal. This prevents tray 10 from being inadvertently pulled completely out of bracket 20. The opening process is completed by tilting tray 10 further downwardly until the front edge of rear flange 17A engages the bottom of cradle 25A, and the rear edge of the rear flange engages the lower surface of plate 21, such that tray 10 is angled downwardly about 45 degrees, as shown in FIG. 3C.

DESCRIPTION—FIG. 4

The fully opened drawer of FIG. 3C is shown here in a perspective view. The front edge of rear flange 17B, which is the compliment of rear flange 17A described in FIGS. 3A to 3C, is shown engaged at the bottom of cradle 25B, while the rear edge of rear flange 17B (not shown) is engaged at the underside of plate 21, such that tray 10 is angled downwardly about 45 degrees.

As positioned, tray 10 allows convenient viewing and access of spice jars 12. Because transverse channels 11 hold jars 12 in lateral rows, each jar 12 is supported by a portion by a portion of a channel 11 while tray 10 is tilted. Therefore, each of jars 12 can be individually removed and replaced without disturbing other jars.

OPERATION—FIGS. 3C, 3B, 3A, 2, and 1—CLOSING

Figure 2:
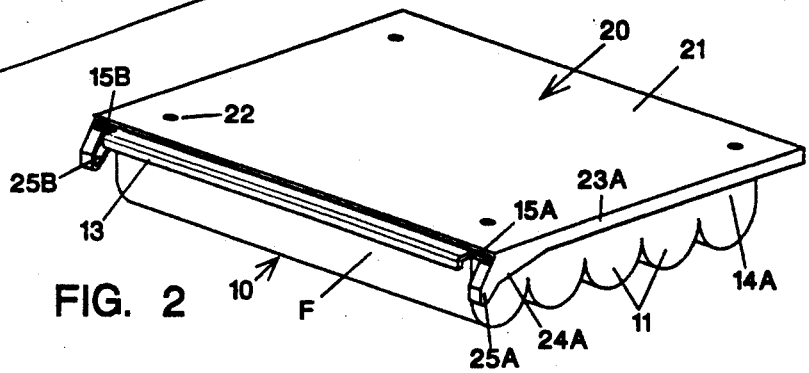
FIG. 2 is a perspective view of the drawer of FIG. 1, with the tray closed.
Figure 4:
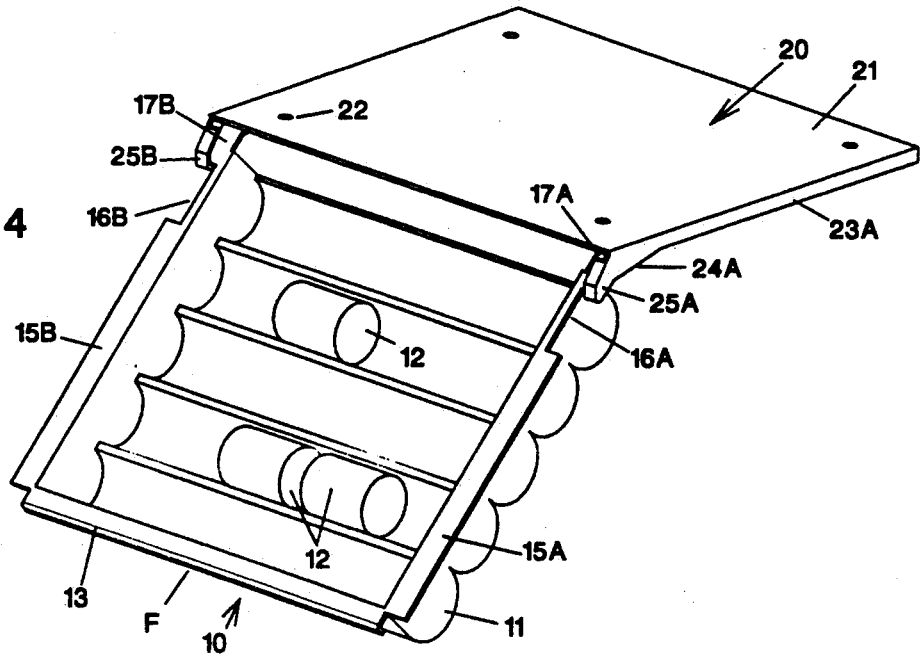
FIG. 4 is a perspective view of the spice drawer of FIG. 1, with the tray in the opened position.

The drawer may be easily closed from the position shown in FIG. 3C by lifting front end F (FIG. 1) of tray 10 to pivot the rear edge of rear flange 17A clockwise, as shown in FIG. 3B. Tray 10 is then lifted to a horizontal position and pushed inwardly such that rear flange 17A rides up sloped portion 24A, as shown in FIG. 3A. Tray 10 is continued to be pushed inwardly until it is fully closed under mounting bracket 20, as shown in FIG. 2.

Tray 10 may be easily removed from mounting bracket 20 for cleaning by pulling it straight out without tilting it, such that the front edges of rear flanges 17A and 17B clear the top edges of cradles 25A and 25B, respectively, as shown in FIG. 1.

In one embodiment of the spice jar drawer, the drawer is molded entirely of a durable plastic such as ABS. It is about 400 mm wide, 300 mm deep, and 55 mm high.

While the above descriptions are specific, they should not be considered as limitations on the scope of the invention, but only as examples of the embodiments. Many other ramifications and variations are possible within the teachings of the invention. Thus, the reader is requested to determine the scope of the invention by the appended claims and their legal equivalents, and not by the examples given.

I claim:

1. A drawer apparatus for mounting under a cabinet, comprising:

a pair of spaced-apart horizontal guide rails each having a front end with a depressed cradle formed therein, each said cradle having a closed bottom portion and a rearwardly inclined front edge.

a substantially horizontal flat connecting member connecting said guide rails, said flat connecting member having a portion positioned above said cradles, a tray comprised of a plurality of parallel semi-cylindrical channels extending transversely between two spaced-apart vertical side walls, a front flange projecting outwardly and orthogonally from each of said vertical side walls into said guide rails, said front flange extending from a front portion of said tray to a position behind a midpoint of said tray, and a rear flange projecting outwardly and orthogonally from a rear portion of each of said vertical side walls into said guide rails, said rear flange being spaced from said front flange, whereby said tray can be placed in a closed position by pushing said tray horizontally along said guide rails and under said cabinet, and whereby said tray can be placed in an open position by pulling said tray outwardly from under said cabinet so that said rear flange is guided down into said cradle by said rearwardly inclined front edge of said cradle, and when said front portion of said tray is lowered to an inclined position, a rear edge of said rear flange will pivot upwardly against said flat connecting member, so that said tray is supported in a downwardly inclined position.

2. The drawer apparatus of claim 1, further including a handle extending from said front portion of said tray.

3. The drawer apparatus of claim 1 wherein said tray is inclined about 45 degrees below a horizontal position when said tray is open.

* * * * *